US005515706A

United States Patent [19]

Paul

[11] Patent Number: 5,515,706

[45] Date of Patent: May 14, 1996

[54] ANGLE BENDER & METHOD

[76] Inventor: David R. Paul, 10217 E. Randwick Dr., Temple City, Calif. 91780

[21] Appl. No.: 294,100

[22] Filed: Aug. 22, 1994

[51] Int. Cl.[6] ..... B21D 5/06

[52] U.S. Cl. ..... 72/31.11; 72/176; 72/379.2

[58] Field of Search ..... 72/176, 177, 35, 72/379.2, 387

[56] References Cited

U.S. PATENT DOCUMENTS

| | | | |
|---|---|---|---|
| 398,781 | 2/1989 | Hovey . | |
| 1,370,060 | 3/1921 | Smith . | |
| 3,070,145 | 12/1962 | Maier | 72/176 |
| 3,241,174 | 3/1966 | Callahan . | |
| 3,387,478 | 6/1968 | Burr | 72/176 |
| 5,311,760 | 5/1994 | Thompson | 72/176 |

FOREIGN PATENT DOCUMENTS

| | | | |
|---|---|---|---|
| 155228 | 9/1985 | European Pat. Off. | 72/35 |

*Primary Examiner*—Daniel C. Crane
*Attorney, Agent, or Firm*—John J. Connors; Connors & Associates

[57] ABSTRACT

A portable angle bender for strip metal. The bender has a shallow U-shaped base having a bending fixture mounted to two upstanding side walls. The bending fixture has two guide members joined at a hinge and pivotally attached to the base on their other ends. One guide member pivots about a fixed axis, while the other may slide relative the base to alter the included angle of the fixture. Each guide member has a slider plate mounted thereunder to form a gap with a top plate to which the central hinge is attached. The gaps are open toward the hinge so as to enable endwise insertion of an angled strip of metal into the fixture. The slider members are constructed of a non-stick material, and the gap is dimensioned to facilitate advancement of the strip through the fixture. A quick-release locking nut is utilized for adjustments to the bending angle, and an indicator is mounted to one of the guide members for registration with a series of angle markings inscribed on the base.

16 Claims, 2 Drawing Sheets

ANGLE BENDER & METHOD

BACKGROUND OF THE INVENTION

1. Field of the Invention

This invention relates to a method and device for bending strips of metal and, more particularly, to a portable strip bending apparatus having a variable angle bending fixture.

2. Background Discussion

In framing construction, angled strips of perforated metal are commonly used to join structural members such as studs and joists, and to cover corners of dry wall construction. These strips of metal are typically fabricated of galvanized steel and are relatively thin and pliable. The strips for the most part are bent at ninety degree angles for joining two right angle surfaces with fasteners through perforations in the strips. Sometimes, the surfaces being joined have an included angle greater than ninety degrees which requires similarly angled joining strips. In these cases, a contractor must purchase special strips bent to the specific angle. Such special lots of strip can be prohibitively expensive. In the alternative, the contractor can purchase strip bent at ninety degrees and commission a sheet metal shop to bend the strips to the desired angle, which is also expensive and time consuming. Due to such expense and trouble in obtaining specially bent strip, there is a need for a simple apparatus and method for bending such strip.

SUMMARY OF THE INVENTION

The device of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its benefits, which include safety and simplicity of use.

The first feature the device of this invention is that it is specifically designed for bending a pliable framing angle piece which has adjoining sides that may be bent to form a desired angular configuration. The device includes a base with a bending fixture thereon having a pair of guide members, and a plurality of markings on the base that indicate what is the bending angle upon movement of said one guide member a position nearby one of said markings.

The second feature is that each guide member has a first end attached to the base and a second end, each of the second ends being joined together by a hinge. One of the first ends is mounted to slide relative to the base to enable the guide members to form a bending angle which may be varied by movement of one of these guide members. Preferably, the guide members are detachably mounted.

The third feature is plate members mounted in spaced relationship to the guide members to provide a gap between the guide members and the plate members. The gap is sufficiently narrow so that by pushing the angle piece edgewise into the gap the adjoining sides of the angle piece are bent into the desired angular configuration. The plate members move in unison with the guide members to maintain the same dimensional spacing between the plate members and guide members, so that the gap dimensional spacing remains of the same dimension upon movement of the guide members into different angular relationships. Preferably, the plate members are made of a material that has a low coefficient of friction. The plate members have ends nearby the hinge which are almost touching when the bending angle is at maximum acuteness and are spaced apart a minimum distance of about one inch when the bending angle is at minimum acuteness. Preferably, the plate members are detachably mounted.

This invention also includes a method for bending a pliable framing angle piece which has adjoining sides that may be bent to form a desired angular configuration. The method includes pushing the angle piece edgewise through a bending fixture having a pair of guide members having ends joined together by a hinge to form a bending angle which may be varied by movement of at least one of said guide members.

DESCRIPTION OF THE DRAWING

The preferred embodiment of this invention, illustrating all its features, will now be discussed in detail. This embodiment depicts the novel and non-obvious method and device of this invention shown in the accompanying drawing, which is for illustrative purposes only. This drawing includes the following figures (Figures), with like numerals indicating like parts.

DESCRIPTION OF THE PREFERRED EMBODIMENT

Figure 1:
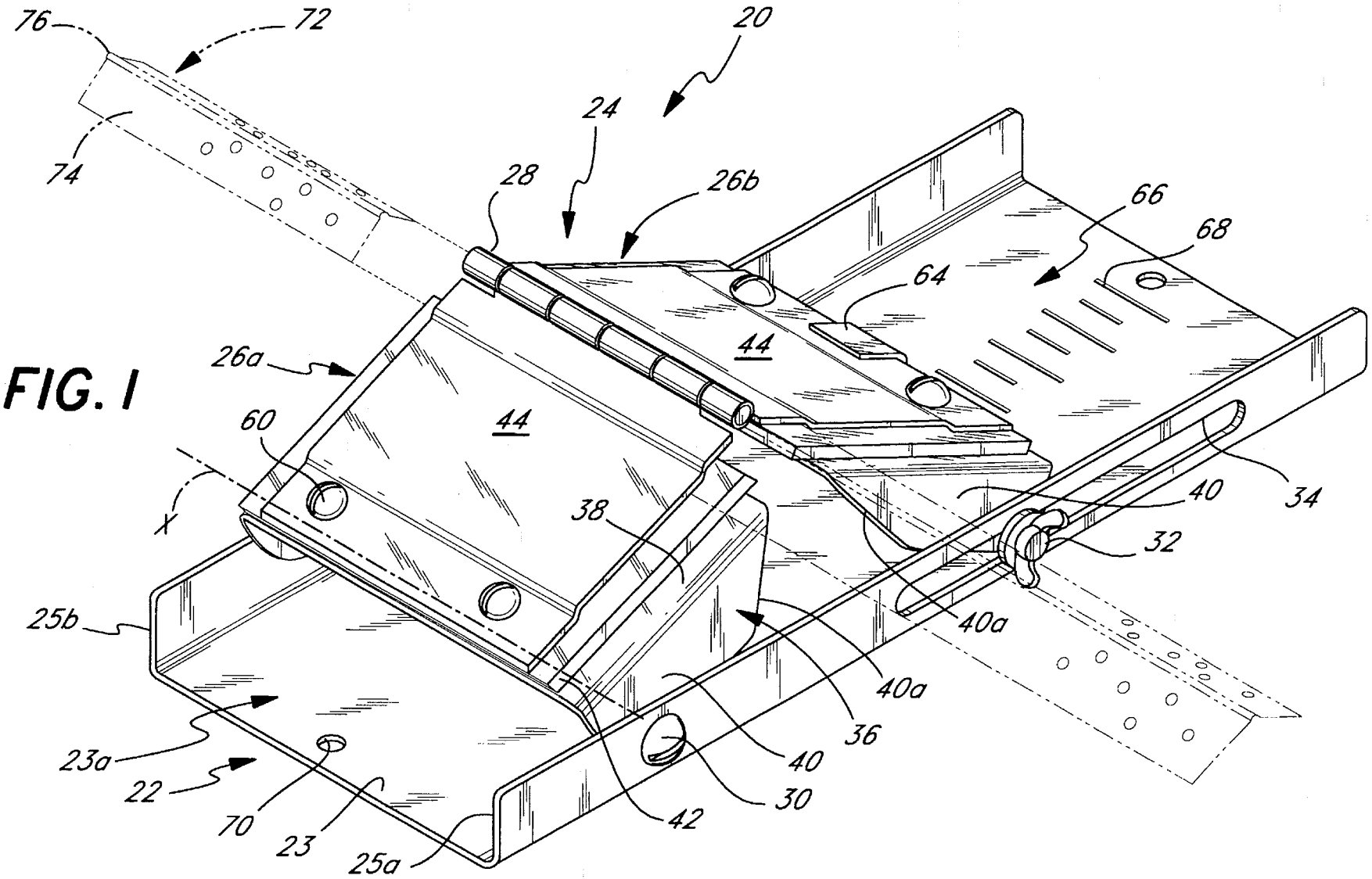
FIG. 1 is a perspective view of one embodiment of an angle bender in accordance with the present invention.

As shown FIG. 1, an angle bender 20 of the present invention includes a base 22 and a bending fixture 24.

In one preferred form, the base 22 comprises a shallow U-shaped rigid element having a flat web portion 23 and two parallel upstanding walls 25*a*, 25*b* on opposite side edges of the web portion. This provides a guide channel 23*a* formed by the walls 25*a*, 25*b* and the web portion 23. One end of the bending fixture is attached in a fixed postion between the walls 25*a*, and 25*b*, so that it pivots along a fixed pivot axis X. The base 22 may take any one of various configurations which provides, as attachment means for the bending fixture 24, a fixed pivot axis and a channel extending along a line that intersects with the fixed pivot axis.

The bending fixture 24 is defined by two identical guide members 26*a*, 26*b*, both pivotally mounted on the base 22 and joined at a hinge 28. The first guide member 26*a* is connected to the base 22 by a pair of pivot bolts 30 (one visible) passing through aligned holes in each wall 25*a*,25*b* and journalled to the guide member. The aligned centers of the bolts define the fixed pivot axis X. The second guide member 26*b* pivots about a sliding axis located wherever a pair of angle adjustment bolts 32 are disposed within slots 34 (only one shown) in the walls 25*a*, 25*b*. The slots 34 are parallel to the web portion 23. The adjustment bolts 32 desirably have wing-type fastening heads for rapid actuation into threaded holes (not shown) in the guide member 26*b*. This eliminates fastening nuts on the tail ends of the nuts. An integral or separate washer surface is preferred for securely tightening the heads of the bolts 32 against the opposed wall sections surrounding the slots 34.

The fixed pivot axis X and slots 34 provide means for adjusting the included angle of the hinged bending fixture 24. In one extreme, the two guide members 26*a*, 26*b* can lie flat parallel to the web portion 23 of the base 22 with the adjustment bolts 32 disposed at a first end of the slots 34 farthest away from the pivot bolts 30. The fixture 24 assumes its smallest included angle by repositioning the adjustment bolt 32 to the end of the slot 34 closest to the pivot bolts 30, with the guide members 26*a*,26*b* forming an inverted V-shape over the web.

Figure 2:
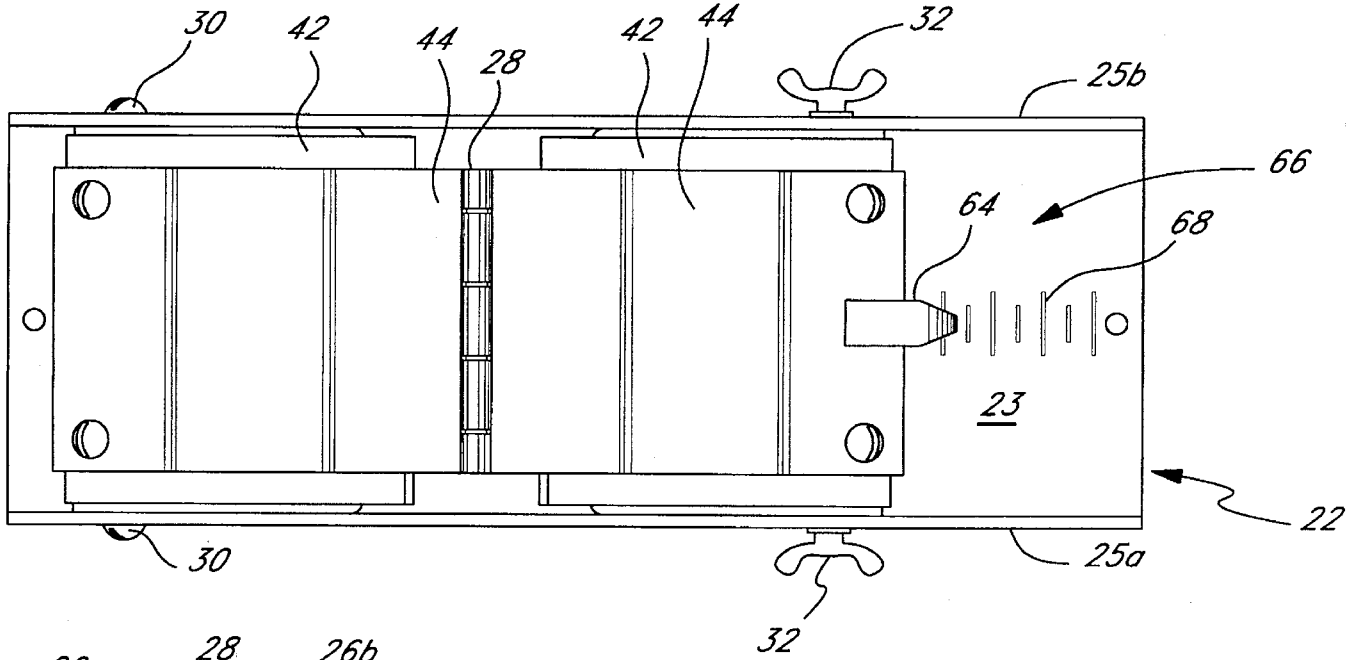
FIG. 2 is a top plan view of the angle bender of FIG. 1.
Figure 3:
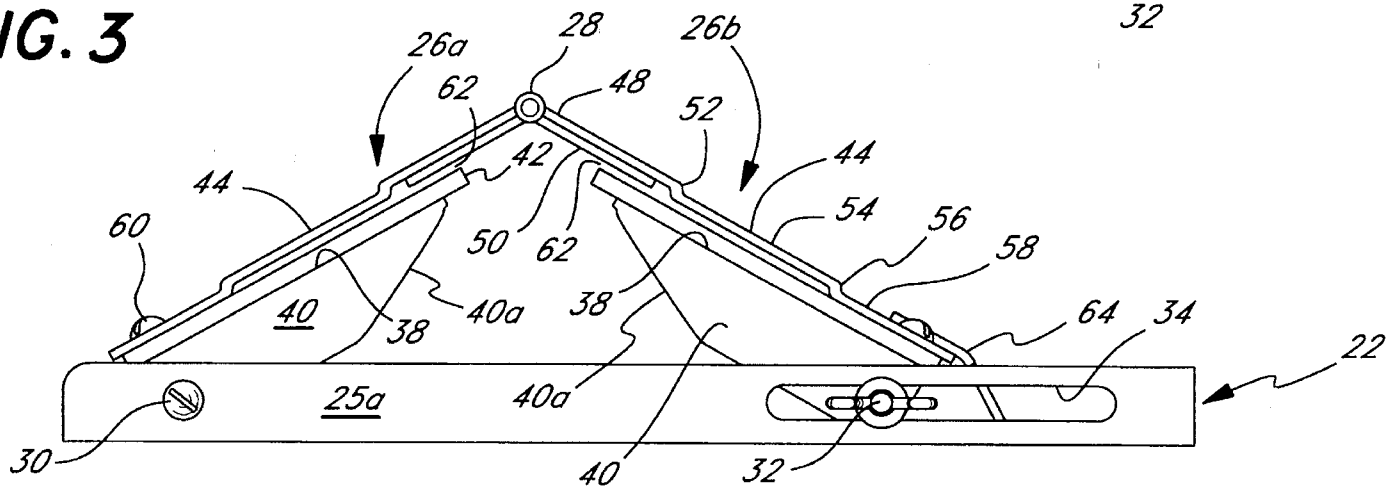
FIG. 3 is a side elevational view of the angle bender of FIG. 1.

Each of the guide members 26*a*,26*b* include a lower arch support 36 having an upper plate 44, a central flat portion 38 with a pair of side flanges 40 at right angles to the flat portion, and a flat slider element 42 disposed between the inside surface of the upper plate and the outer surface of the flat portion. As illustrated in FIG. 2, each slider member 42 is sized approximately the width of the arch members 36. The upper plates 44 are somewhat narrower in width. This arrangement exposes edges portions of the slider members 42 on each lateral side of the upper plates 44, the purpose of which will become apparent below. The side flanges 40 are parallel to and spaced apart slightly less than the side walls 25*a*,25*b*. The bolts 30 and 32 thus extend through the respective apertures in the side walls 25*a*,25*b* into holes in the flanges 40. Angled edges 40*a* provide clearance between the flanges 40 at small included angles of the bending fixture 24, as best seen in FIG. 3.

Each upper plate 44 includes a first planar section 48 attached to one of two hinge flaps 50. Each plate also has three planar steps sections 52, 54, and 58. A pair of fasteners, such as bolts 60, firmly attach the third planar section 58 of each section 48 to the slider members 42 and also to each central portion 38 of the arch support 36. Each first step section 52 is configured to ensure that the hinge flaps 50 are coplanar with the second sections 54. The first step section 52, with the hinge flaps 50 seated snug against the inside surface of this first step section, provide a planar gap 62 between the hinge flaps and the slider members 42.

As mentioned previously, the guide members 26*a*,26*b* are identical, with the exception of the guide member 26*b* has an indicator pointer 64 mounted on one end. The indicator pointer 64 projects downward toward a central portion 66 of the base 22 and is aligned with a plurality of markings 68. The indicator pointer 64 in conjunction with the markings 68 can be used to determine the angle at which the bending fixture 24 is positioned. Other angle indicators may also be used.

In use, the base 22 is preferably secured to a foundation via a pair of mounting holes 70. The bending fixture 24 is set at an angle at which an angle piece 72 is to be bent. To accomplish this, the two adjustment bolts 32 are loosened and slid along the slots 34 until the indicator pointer 64 aligns with the desired angle marking 68. Then the adjustment bolts 32 are fastened tightly. The angle piece 72 is inserted endwise into the bending fixture 24 with adjoining sides 74 extending into the gaps 62 in each guide member 26*a*,26*b*, the apex 76 of the angle piece is disposed adjacent the hinge 28. The most common usage of the present invention is for increasing the included angle of a 90 degree angle piece. To this end, the portions of the slider members 42 exposed to the lateral sides of the upper plates 44 allow the operator to place an initial length of the angle piece 72 thereon and spread the angle piece to fit the apex 76 under the hinge 28. By pushing the angle piece 72 through the bending fixture 24 the desired included angle is formed.

The slider members 42 are preferably constructed of a self-lubricating material, such as NYLON or DELRIN. The angle piece 72 thus slides easily through the bending fixture 24 despite the natural tendency of the strip metal angle piece 72 to resist deformation. The gap 62 is sized slightly larger than the strip thickness to facilitate the advancement of the angle piece 72 therethrough and accommodate for some bowing of the piece.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention.

I claim:

1. A device for bending a pliable framing angle piece which has adjoining sides that may be bent to form a desired angular configuration, including a base, a bending fixture having a pair of guide members, each guide member having a first end attached to the base and a second end, each of said second ends being joined together by a hinge, one of the first ends being mounted to slide relative to the base to enable the guide members to form a bending angle which may be varied by movement of one of said guide members, plate members mounted in spaced relationship to the guide members to provide a gap between the guide members and the plate members, said gap being sufficiently narrow so that by pushing the angle piece edgewise into the gap the adjoining sides of the angle piece are bent into the desired angular configuration, said plate members moving in unison with the guide members as said one of said guide members is moved to maintain the same dimensional spacing between the plate members and guide members, so that the gap dimensional spacing remains of the same dimension upon movement of the guide members into different angular relationships, and a plurality of markings on the base that indicate what is the bending angle upon movement of said one guide member a position nearby one of said markings.

2. The device of claim 1 where the plate members are made of a material that has a low coefficient of friction.

3. The device of claim 1 where the plate members have ends nearby the hinge which are almost touching when the bending angle is at maximum acuteness and are spaced apart a minimum distance of about one inch when the bending angle is at minimum acuteness.

4. The device of claim 1 where the plate members are detachably mounted.

5. The device of claim 1 where the guide members are detachably mounted.

6. A device for bending a pliable framing angle piece which has adjoining sides that may be bent to form a desired angular configuration, including a base, a bending fixture having a pair of guide members, each guide member having a first end attached to the base and a second end, each of said second ends being joined together by a hinge, one of the first ends being mounted to slide relative to the base to enable the guide members to form a bending angle which may be varied by movement of one of said guide members, and said guide members including upper plate members joined at said hinge and sliding members mounted between said upper plate members and said base to provide a planar gap with the plate members open to a hinge side, said gap being sufficiently narrow so that by pushing the angle piece edgewise into the gap the adjoining sides of the angle piece are bent into the desired angular configuration, said sliding members extending wider than said upper plate members to expose a portion of the sliding members for initiating the entry of an angle piece into said bending fixture.

7. The device of claim 6 where the plate members are made of a material that has a low coefficient of friction.

8. The device of claim 6 where the plate members have ends nearby the hinge which are almost touching when the bending angle is at maximum acuteness and are spaced apart a minimum distance of about one inch when the bending angle is at minimum acuteness.

9. The device of claim 6 where the plate members are detachably mounted.

10. The device of claim 6 where the guide members are detachably mounted.

11. A method for bending a pliable framing angle piece which has adjoining sides that may be bent to form a desired angular configuration, including pushing the angle piece edgewise through a bending fixture having a pair of guide members having ends joined together by a hinge to form a bending angle which may be varied by movement of at least one of said guide members, said bending fixture including plate members mounted in spaced relationship to the guide members to provide a gap between the guide members and the plate members, said gap being sufficiently narrow so that by pushing the angle piece edgewise into the gap the adjoining sides of the angle piece are bent into the desired angular configuration, said plate members moving in unison with the guide members as said one of said guide members is moved to maintain the same dimensional spacing between the plate members and guide members, so that the gap dimensional spacing remains of the same dimension upon movement of the guide members into different angular relationships.

12. The method of claim 11 where the bending fixture, includes a plurality of markings on the base that indicate what is the bending angle upon movement of said one guide member a position nearby one of said markings.

13. The device of claim 11 where the plate members are made of a material that has a low coefficient of friction.

14. The device of claim 11 where the plate members have ends nearby the hinge which are almost touching when the bending angle is at maximum acuteness and are spaced apart a minimum distance of about one inch when the bending angle is at minimum acuteness.

15. The device of claim 11 where the plate members are detachably mounted.

16. The device of claim 11 where the guide members are detachably mounted.

* * * * *